US005558315A

United States Patent [19]

Constantinescu et al.

[11] Patent Number: 5,558,315

[45] Date of Patent: Sep. 24, 1996

[54] MULTI-FOLD INTERLOCKABLE SPRING FOR USE IN MATTRESS FOUNDATION ASSEMBLIES

[75] Inventors: Eugen Constantinescu, Westlake; Robert F. Wagner, Medina, both of Ohio

[73] Assignee: Ohio Mattress Licensing and Components Group, Cleveland, Ohio

[21] Appl. No.: 295,931

[22] Filed: Aug. 25, 1994

[51] Int. Cl.[6] ..... F16F 3/00

[52] U.S. Cl. ..... 267/103; 267/154; 267/155; 5/247

[58] Field of Search ..... 267/154, 155, 267/103, 131, 142, 104, 105; 5/247, 255, 267, 276, 476

[56] References Cited

U.S. PATENT DOCUMENTS 4,060,862 12/1977 Kitchen et al. .
4,339,834 7/1982 Mizelle .
4,470,584 9/1984 Mizelle .
4,666,136 5/1987 Hagemeister ..... 267/103
4,779,292 10/1988 Dabney .
4,779,293 10/1988 Dabney et al. .
4,921,228 5/1990 Lowe .
4,932,535 6/1990 Dabney .
5,165,667 11/1992 Dabney ..... 267/103
5,346,190 9/1994 Dabney ..... 267/103
5,438,716 8/1995 Dabney ..... 267/103

*Primary Examiner*—Robert J. Oberleitner
*Assistant Examiner*—C. T. Bartz
*Attorney, Agent, or Firm*—Calfee Halter & Griswold

[57] ABSTRACT

A foundation spring module especially adapted for easy assembly in an interlocking spring and grid bedding foundation structure has a short generally vertical section which extends down from an interlockable wire grid-engaging horizontal top portion to position an upper end of each of two contiguous legs of the spring away from the area of intersection of the top portion and legs of the spring with the wire grid to greatly ease manipulation and assembly of the spring into the interlocked position in the wire grid of the foundation structure.

22 Claims, 4 Drawing Sheets

MULTI-FOLD INTERLOCKABLE SPRING FOR USE IN MATTRESS FOUNDATION ASSEMBLIES

FIELD OF THE INVENTION

The present invention relates generally to bedding foundation assemblies and, in particular, to multi-fold non-coil spring modules for use in bedding foundation assemblies.

BACKGROUND OF THE INVENTION

Mattress foundations, sometimes referred to as "box springs", consist generally of a wooden frame having multiple cross pieces which may be constructed of steel, and a plurality of wire form springs attached to the frame and cross pieces, and at a top portion to a wire grid or "deck" which serves as a supporting surface for a mattress. The use of non-coil type springs in mattress foundations is disclosed, for example, in U.S. Pat. Nos. 4,339,834, 4,739,977, 4,921,228 and 4,932,535. Mattress foundations of this type, i.e., utilizing limited deflection non-coil springs connected to a foundation frame and a wire grid support deck, have the advantages of providing a firm but flexible support for the wire grid deck and limited deflection characteristics to avoid overstressing and permanent deformation.

U.S. Pat. No. 4,921,228 discloses a non-coil spring mattress foundation wherein a generally horizontal base portion of the spring is attached to the foundation frame by staples, and a generally horizontal deck attaching portion is secured to the wire grid of the deck without separate fasteners by underlapping and overlapping with a linear section of the grid which traverses the spring to interlockingly engage the grid. The base portions of the spring can alternatively be attached to steel cross pieces of the foundation frame by insertion of a base portion of each leg of the spring through aligned slots formed in the cross-piece, as disclosed in U.S. Pat. No. 4,470,584.

Other types of non-coil springs having generally horizontal upper portions can be assembled into foundation structures by overlap/underlap interlocking with linear sections of the grid. For example, FIG. 5 illustrates a foundation assembly described by U.S. Pat. No. 4,932,535 which has a unitary wire body spring 100 having a horizontal load bearing portion 102 which is interlockable with a wire grid support deck 104, and generally vertical deflectable spring legs 106 which are configured to maximize lateral stability and minimize skewing at full deflection.

A significant difficulty encountered in the customary hand assembly of this type of foundation is the insertion and interlocking of each spring into the wire grid deck. In particular, to interlock the horizontal load bearing portion of the spring with the linear section of the wire grid requires that the vertical legs of the spring be inserted past the grid, and opposite corners of the horizontal load bearing section manipulated under the single wire of the grid in opposite directions by rotating the spring, with the section of the top portion of the spring connecting the two corners crossing over the top of the wire. This complicated assembly task is necessarily done by hand for each of the approximately thirty to thirty-five springs in each queen size foundation. The process is made even more difficult in foundations in which the base portion of each spring is secured to the frame by insertion of the spring feet into aligned transverse slots in the frame cross-sections (as described by the '584 patent). In this case, the spring feet must be positioned on opposite sides of the cross-section for insertion into the slots as the top portion is manipulated into the interlocked position with the wire grid.

Although the basic configuration of the spring described in the '535 patent has good deflective and support characteristics when assembled in a foundation in this manner, the difficulty of the assembly process emanates from the compound intersection shown in FIG. 5 of wire grid section cross wire 108 with the downwardly angled bend 114 between torsional member 110 and downwardly angled member 112. The close binding proximity of the downwardly angled bend 114 with cross wire 108 of the grid acts to resist insertion of the spring into the fully interlocked and aligned position. Specifically, an upper surface of the wire at downwardly angled bend 114 impinges directly upon cross wire 108 as the spring is forcibly rotated into interlocking engagement with the grid. This resistance is substantial due to the rigidity of the wire section of the grid and the spring and therefore increases the difficulty of the hand assembly process significantly. This difficulty of assembly of course contributes to increased production time and assembler fatigue.

SUMMARY OF THE PRESENT INVENTION

The present invention overcomes the above described difficulties and disadvantages of foundation springs of the prior art while retaining the performance benefits of interlocking non-coil spring type mattress foundations. The invention accomplishes this by providing a short vertical section in each leg which extends vertically downward from a top horizontal portion of the spring which engages the wire grid. The presence of the short vertical section in each leg immediately adjacent the top horizontal portion eliminates binding at the point of intersection of the spring legs with the wire grid to thereby minimize resistance to insertion of the spring into the interlocked position with the wire grid.

In accordance with one aspect of the present invention, a multiple fold spring module is provided for interlocking assembly in a mattress foundation. The spring has a generally horizontal top portion adapted to engage a mattress supporting wire grid. The top portion has two parallel torsional end members adapted to transversely underlap and engage wire elements of the grid when in the interlocked position. Each torsional end member is connected in the horizontal plane of the top portion to a parallel central section adapted to transversely overlap the same wire element of the grid. Each spring further includes two deflectable legs, each leg having a first relatively short vertical section which extends vertically downward from the torsional end section and connected through a bend to a first angled section angled inward toward the other leg of the spring. The length of the first vertical section is sufficient to position the upper end of the first angled section out of range of contact with the wire element which the torsional end member underlaps, both during installation of the wire and in the final assembled position.

The first angled section is connected through a bend at a lower end to a second torsional member disposed generally horizontal and parallel to the torsional end section. An opposite end of the second torsional member is connected through a bend to a second relatively long vertical member which is connected through a bend at a lower end to a third torsional member generally parallel and below the second torsional member. The third torsional member is connected through a bend to a second angled section which is angled inward and down toward the center of the wire. The second angled section is connected through a bend at a lower end to a fourth torsional member at the base of the spring. The fourth torsional member is connected to a base member having a clip notch adapted for locking insertion into an element of a frame of a mattress foundation.

These and other aspects of the invention will become apparent to those skilled in the art upon reading and understanding the following detailed description made with reference to the annexed drawings wherein like reference numerals refer to like parts.

DETAILED DESCRIPTION OF A PREFERRED EMBODIMENT

Figure 1:
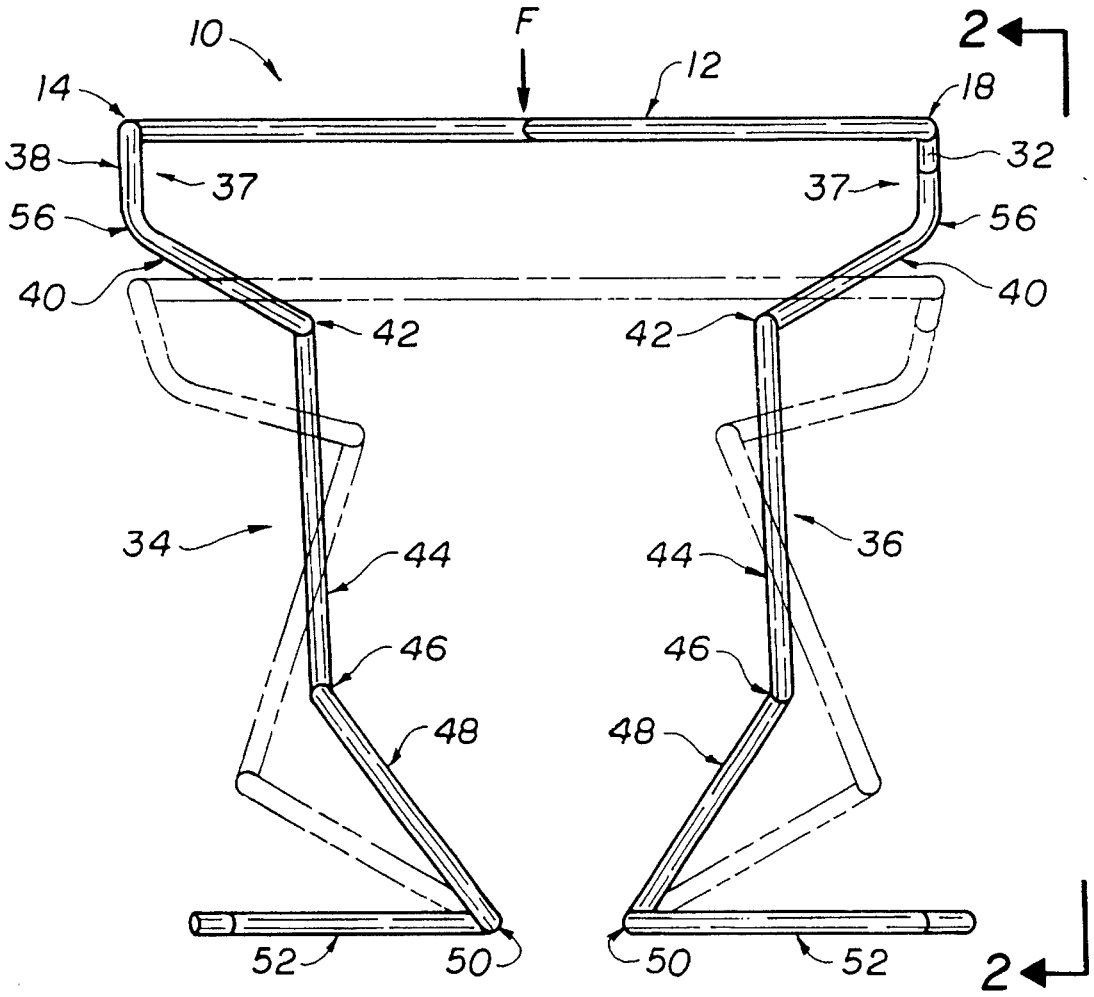
FIG. 1 is a side elevation of a spring of the present invention.
Figure 2:
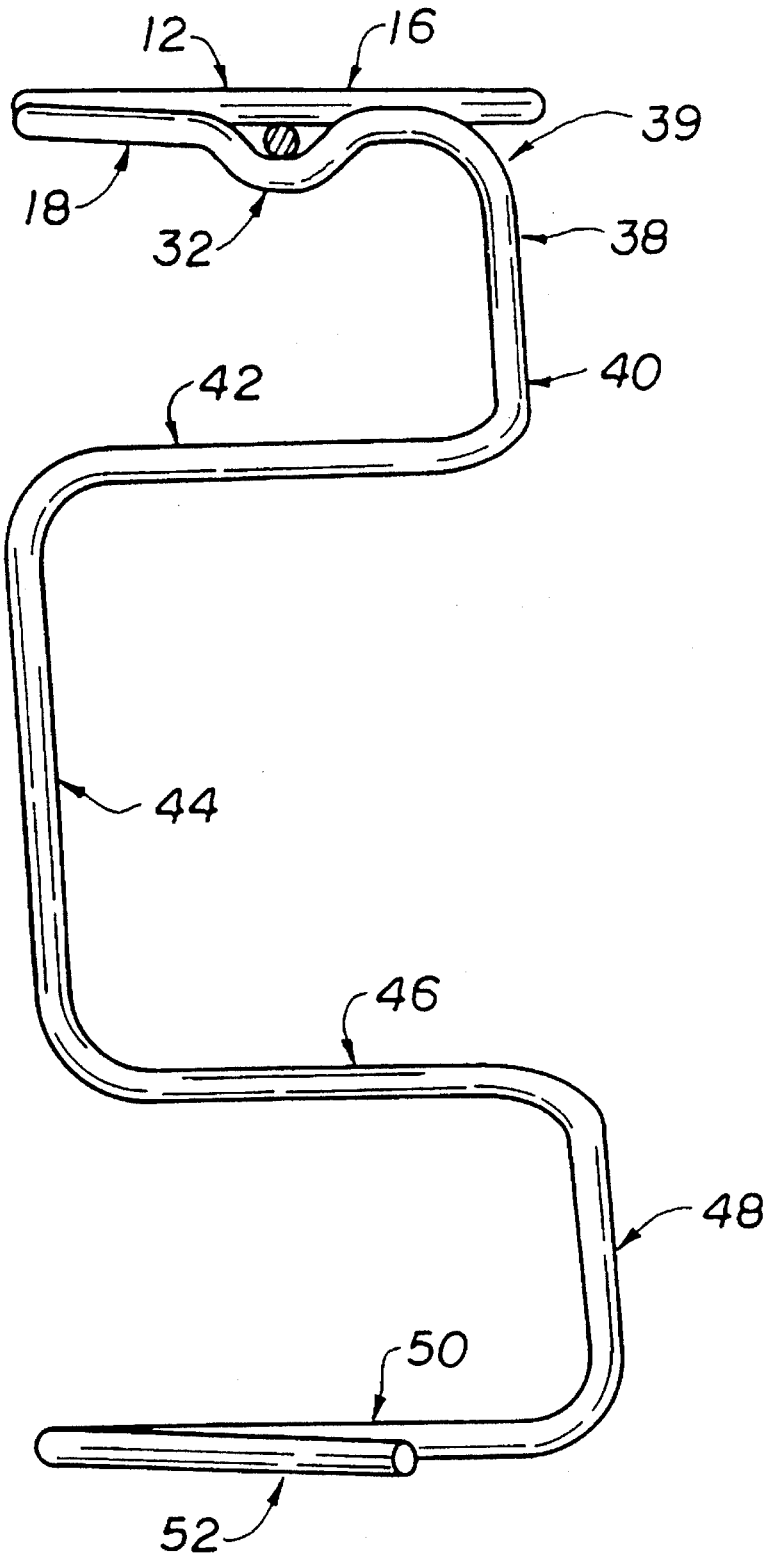
FIG. 2 is a side elevation of a spring of the present invention, taken in the direction of the arrows 2—2 in FIG. 1.
Figure 3:
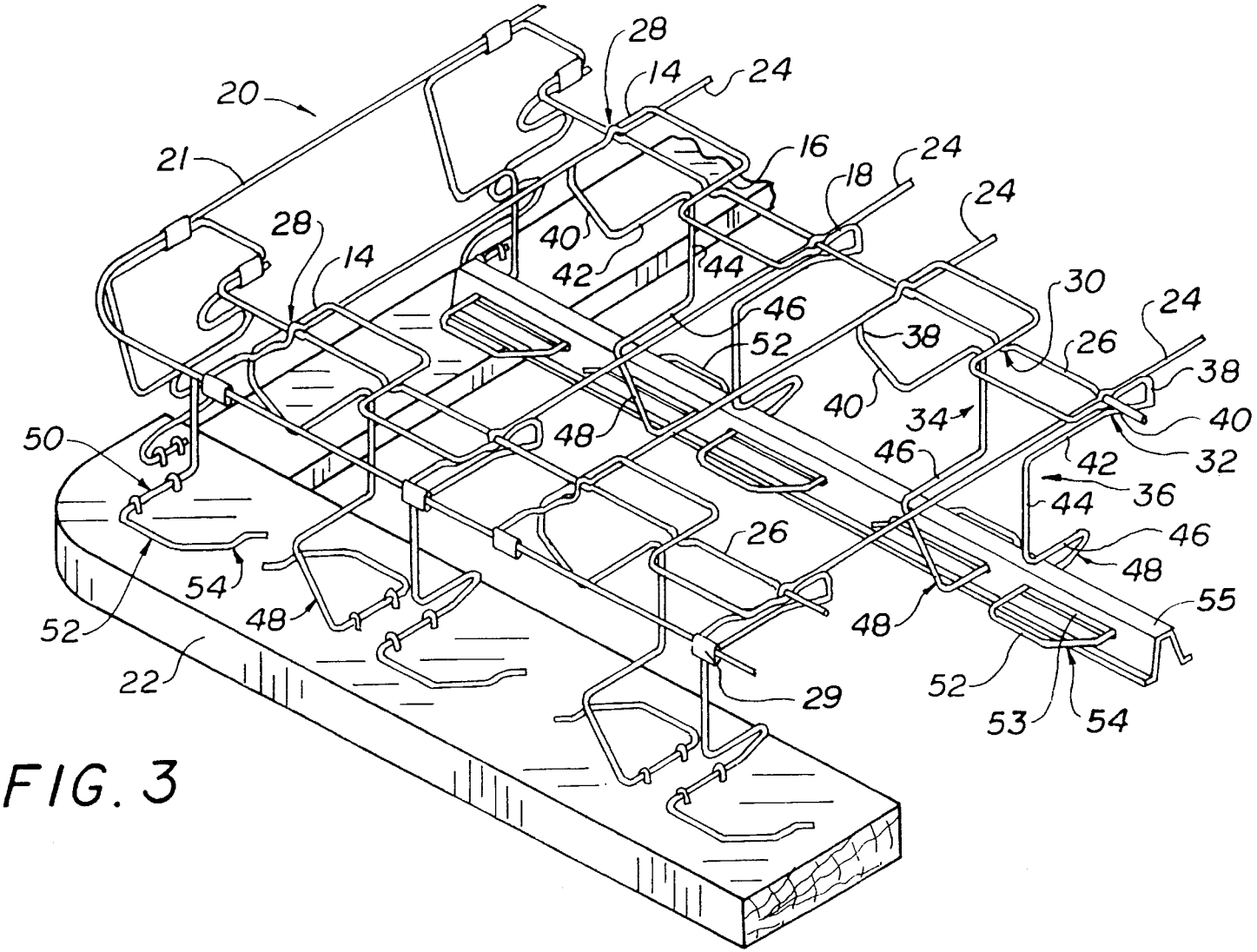
FIG. 3 is a perspective of a portion of a foundation assembly incorporating springs of the present invention.

As illustrated in FIGS. 1, 2 and 3, the spring 10 of the present invention includes a generally horizontal section 12 having three generally parallel members 14, 16 and 18 adapted to interlock with the horizontal matrix of a wire grid 20 which forms a mattress supporting deck. Wire grid 20 includes an edge wire 21 which conforms to the perimeter of a foundation frame 22, longitudinal elements 24 and cross piece elements 26. Longitudinal elements 24 overlap and engage cross piece elements 26 at notch points 28 formed in longitudinal elements 24, and are attached to edge wire 21 by clip fasteners 29.

Horizontal section 12 of spring 10 includes a central arm 16, disposed generally parallel to longitudinal elements 24 and supported and positionally engaged by inverted notch 30 formed in cross piece element 26. Torsional end members 14 and 18 are generally parallel to central arm 16 and each have a notch 32 adapted to compressively underlap and engage cross piece elements 26.

The spring 10 further includes two legs 34 and 36, each having a first vertical section 38 which extends a relatively short distance (for example, approximately one centimeter) down from the respective end members 14 and 18 of horizontal section 12, thereby providing a clearance area 37 between wire grid 20 and the remaining sections of spring legs 34 and 36. As shown in FIG. 2, a radiused bend 39 connects an upper end of each first vertical section 38 with respective end members 14 and 18. Radiused bend 39 is formed with a relatively large radius of curvature, for example, as large as the radius of any other bend in the spring, to provide a smooth bearing surface for contact and passage of this portion of the spring against cross piece elements 26 upon insertion of the spring into the interlocked position with the grid. Thus the radiused bend 39 in combination with the first vertical section 38 minimizes contact and frictional resistance with cross piece elements 26 of the grid upon insertion of the spring into the interlocked position.

Figure 4:
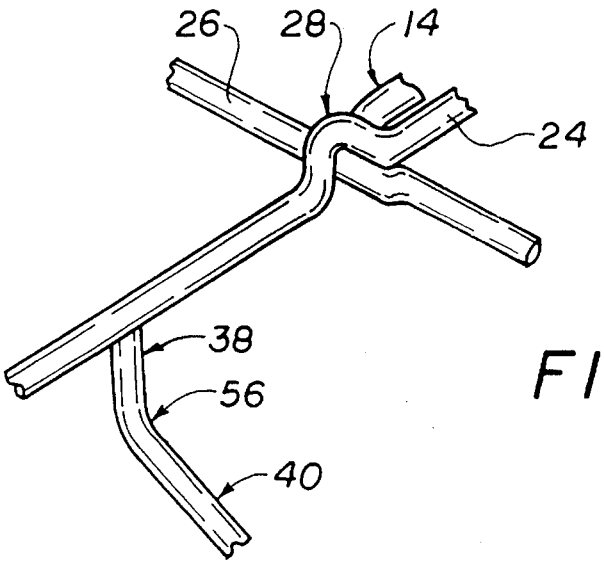
FIG. 4 is an enlarged perspective of an area of intersection of a portion of the spring of the present invention with a portion of a wire grid of a foundation assembly.
Figure 5:
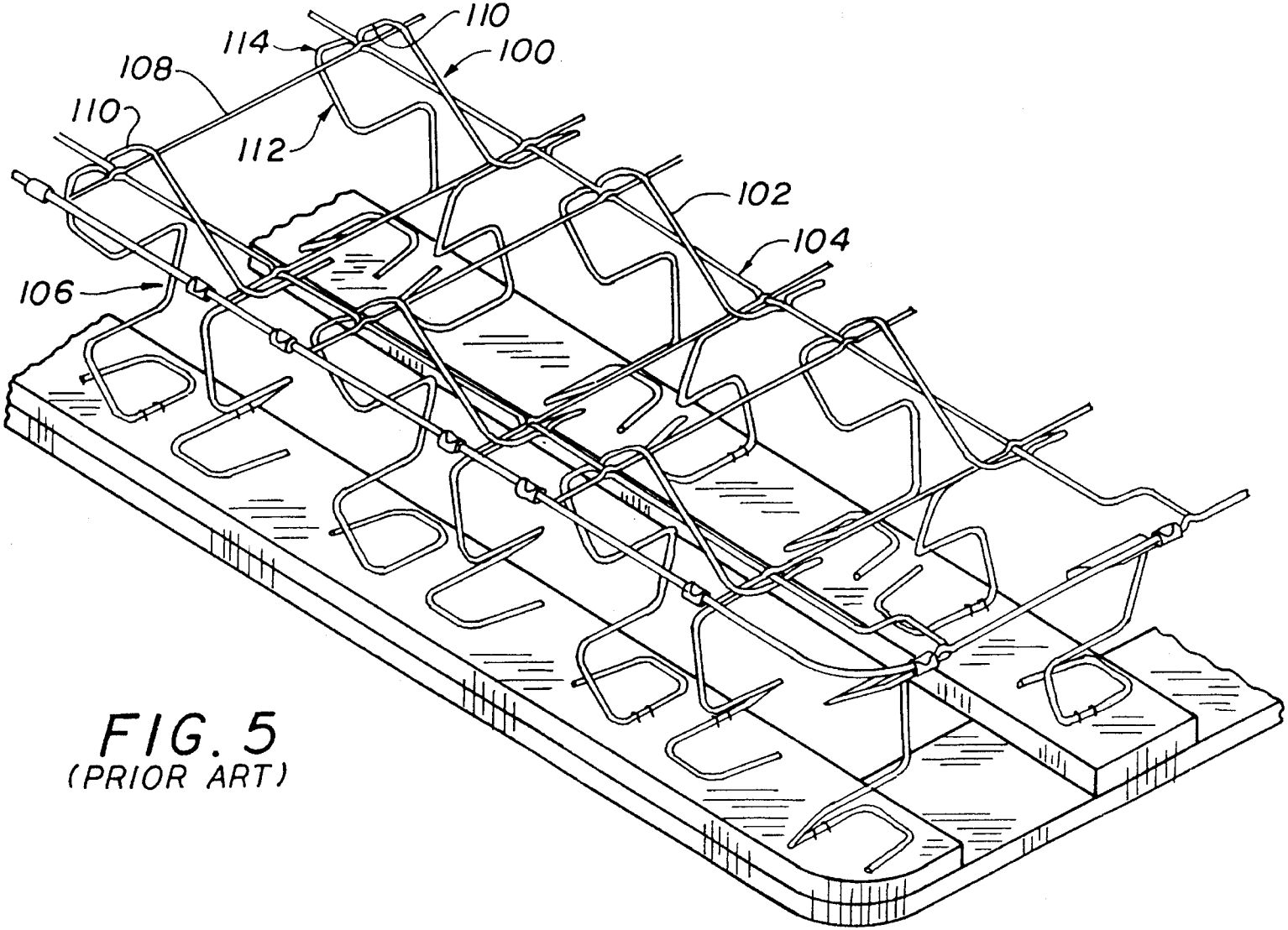
FIG. 5 (PRIOR ART)
FIG. 5 is a perspective of a portion of a foundation assembly of the prior art.

Each leg of the spring is form bent in a contiguous manner to further include a first inwardly angled section 40 extending down from a lower end of first vertical section 38 and inward toward the other leg. As illustrated in enlarged detail in FIG. 4, the presence of first vertical section 38 positions the upper end of angled section 40 below and away from the area of convergence of the outer end of end member 14 (and 18) and longitudinal element 24 of the wire grid. In the absence of vertical section 38 (such as in the prior art shown in FIG. 5), angled section 40 would have to be forced into position to underlappingly traverse longitudinal element 24 with end member 14 (and 18) positioned immediately adjacent longitudinal element 24. The presence of vertical section 38 eliminates this source of resistance to installation of the spring into the interlocked position with the wire grid.

A lower end of first angled section 40 is connected through an approximately ninety degree bend to a generally horizontal torsional member 42, connected through a bend at an opposite end to a relatively long second generally vertical section 44, which is connected through a bend at a lower end to another generally horizontal torsional member 46. Torsional member 46 is connected through a bend at an opposite end to a second inwardly angled section 48, angled down and in toward the other leg. Angled section 48 is connected through a bend at a lower end to another torsional member 50 which forms a part of the base of the leg attachable to a portion of a foundation frame. Torsional member 50 is connected through a bend at an opposite end to a generally horizontal foot section 52. Foot section 52 includes a bend 54 which forms a biased clip lockingly insertable into aligned slots 53 of, for example, a steel foundation cross span 55, as described in U.S. Pat. No. 4,779,292.

As shown in FIG. 1, upon application of a force F in the direction shown upon horizontal section 12 of the spring, vertical sections 38 transfer the force through first angled sections 40 to a compressed position (shown in phantom lines) and induce torsion in members 42, and driving vertical sections 44 generally vertically downward, inducing torsion in members 46 and moving angled sections 48 to the compressed position, and inducing partial torsion in members 50.

The spring of the present invention is generally stiffer than non-coil interlockable foundation springs of comparable size of the prior art. This is a result of the presence of the first vertical section 38 which effectively shortens and necessitates a bend 56 in the moment arm between torsion members 42 and torsional end members 14 and 18. The shortened length of the first inwardly angled section 40 requires a greater amount of force to induce torsion in members 14 (or 18) and 42. The spring is therefore stiffer and better suited to provide a firm and durable foundation structure. The interior angle of bend 56 is substantially greater than ninety degrees.

The novel spring of the present invention thus provides an improved deflective element which is much more easily assembled into a mattress foundation structure than other types of spring elements. Although the spring of the present invention is inserted into foundation structure in much the same manner as the described spring of the prior art, clearance area 37 allows the top horizontal portion of the spring to be lockingly engaged with the wire grid of the foundation without interference from the angled sections of the legs of the spring. Because each of the springs are assembled into the foundation structure by hand, this significant improvement in the ease of assembly substantially reduces the difficulty and time of mattress foundation production and minimizes assembly worker fatigue.

Although the invention has been described in detail with respect to a particular embodiment, certain variations and modifications may become apparent to those skilled in the art upon reading this specification. Any such variations and modifications are within the purview of this invention, which is defined for now by the claims equivalents and all equivalents thereto.

What is claimed is:

1. A spring element formed from a single piece of wire having a plurality of bends to form a plurality of generally linear sections and members, adapted for assembly in plural numbers in a mattress foundation structure having a frame and a wire grid mattress supporting deck, the spring element comprising:

(i) a generally horizontal top portion attachable to a horizontal mattress supporting deck, the horizontal top portion having a central member positionable to overlappingly traverse a piece of the wire grid mattress supporting deck, and two first torsional end members parallel to the central member and positionable to traverse and underlap pieces of the mattress supporting deck, the central and end members connected by two generally parallel cross members, (ii) a deflectable leg extending downward from each of the first torsional end members of the top portion, each of the legs having, a first vertical section extending generally vertically downward from an end of the first torsional end member, a first angled section extending from a lower end of the first vertical section and angled down and inward toward the other leg, a generally horizontal second torsional member extending from a lower inward end of the first angled section and generally horizontal and parallel to the first torsional end member, a second vertical section extending generally vertically downward from an end of the second torsional member, a third torsional member connected to a lower end of the second vertical section, the third torsional member connected to a second angled section angled inward and down toward the other spring, the second angled section terminating at a fourth generally horizontal torsional member, and (iii) a base section attached to the fourth torsional member and configured for attachment to an element of a frame of a mattress foundation structure.

2. The spring element of claim 1 wherein each of the end members of the top portion include a notch for receiving the piece of the mattress supporting deck.

3. The spring element of claim 2 wherein the notch is in the form of a U-shaped depression in the middle of the length of the end member.

4. The spring element of claim 1 further comprising a radiused bend between an end of the end member and an upper end of the first vertical section, the radiused bend having a radius at least as large as the radius of every other bend in the spring element.

5. The spring element of claim 2 wherein the radiused bend extends from the notch to an upper end of the first vertical section.

6. The spring element of claim 1 wherein the length of the first vertical section is approximately one centimeter.

7. The spring element of claim 3 wherein the length of the first vertical section is approximately equal to the length of the portion of the end member between the notch and the radiused bend.

8. The spring element of claim 4 wherein the radiused bend is disposed in a plane generally perpendicular to the top portion.

9. The spring element of claim 1 wherein the first vertical section is disposed in the same plane as the first angled section.

10. The spring element of claim 1 wherein the first vertical section is disposed in the same plane as the second angled section.

11. The spring element of claim 1 wherein the first vertical section acts as a moment arm upon the connected end member as the spring is compressed.

12. The spring element of claim 1 wherein each leg has at least six linear sections between the end member of the top portion and the fourth torsional member.

13. The spring element of claim 1 wherein each leg has at least five bends between linear sections between the end member of the top portion and the fourth torsional member.

14. The spring element of claim 1 wherein each leg includes at least one bend between linear sections which has an interior angle substantially greater than ninety degrees.

15. The spring element of claim 1 wherein the first, second, third and fourth torsional members are generally parallel.

16. The spring element of claim 1 wherein the first and second vertical sections are generally parallel.

17. A non-coiled spring module for assembly in plural numbers in a bedding foundation structure having a frame and a mattress supporting deck in the form of a wire matrix, the spring module formed from wire bent at plural points to comprise:

a generally horizontal top portion including first opposed parallel torsional members interlockingly engageable with the mattress supporting deck, a compressible leg connected to each of said opposed parallel torsional members, each leg having a relatively short generally vertical section disposed substantially perpendicular to and extending downward from said top portion, a first angled member extending downward from said relatively short vertical section and angled toward an opposed compressible leg, a second generally horizontal torsional member attached at a downward end of said first angled member, a relatively long generally vertical section attached at one end to the second torsional member and at an opposite end to a third generally horizontal torsional member, a second angled member extending downward from said third torsional member and angled toward an opposed compressible leg and attached to a fourth generally horizontal torsional member, and a base portion attached to said fourth torsional member and configured for engagement with a frame member of a foundation structure.

18. The spring module of claim 17 wherein each of the first opposed parallel torsional members includes a notch engageable with a piece of the wire matrix of the foundation structure.

19. The spring module of claim 17 wherein the two vertical sections in each leg are generally parallel.

20. The spring module of claim 17 wherein the lengths of the two vertical sections in each leg are not equal.

21. A non-coiled spring module for assembly in a bedding foundation structure having a frame and a mattress supporting deck in the form of a wire matrix, said spring module formed from a wire bent at plural points to comprise:

a generally horizontal top portion including opposed parallel first torsional members interlockingly engagable with the mattress supporting deck;

a compressible leg connected to each of said opposed parallel torsional members, each compressible leg having a relatively short vertical section connected to an associated opposed parallel first torsional member, said relatively short vertical section and associated opposed parallel first torsional member together defining a clearance area for receipt of a top portion of said wire matrix during assembly of said bedding foundation, each compressible leg further having a first angled member extending downward from said relatively short vertical section and angled toward an opposed compressible leg, a second generally horizontal torsional member attached at a downward end of said first angled member, a relatively long generally vertical section attached at one end to the second torsional member and at an opposite end to a third generally horizontal torsional member, a second angled member extending downward from said third torsional member and angled toward an opposed compressible leg and attached to a fourth generally horizontal torsional member, said fourth torsional member attached to a base portion adapted for engagement with a frame of a foundation structure.

22. The spring module of claim 21 wherein the junction of each relatively short vertical section with its associated opposed parallel torsional member is in the form of a radiused bend having a relatively large radius of curvature to thereby provide a smooth bearing surface for contact and passage of said short vertical section and radiused bend against an associated portion of said wire matrix during assembly of said bedding foundation.

* * * * *